US007690155B2

(12) United States Patent
Isomura

(10) Patent No.: US 7,690,155 B2
(45) Date of Patent: Apr. 6, 2010

(54) WINDOW REGULATOR FOR VEHICLE

(75) Inventor: Yukio Isomura, Chita (JP)

(73) Assignee: Aisin Seiki Kabushiki Kaisha, Kariya-shi, Aichi-ken (JP)

( * ) Notice: Subject to any disclaimer, the term of this patent is extended or adjusted under 35 U.S.C. 154(b) by 0 days.

(21) Appl. No.: 12/314,405

(22) Filed: Dec. 10, 2008

(65) Prior Publication Data

US 2009/0145034 A1 Jun. 11, 2009

(30) Foreign Application Priority Data

Dec. 11, 2007 (JP) ..... 2007-319591
Mar. 31, 2008 (JP) ..... 2008-089660

(51) Int. Cl.
*E05F 11/48* (2006.01)

(52) U.S. Cl. ..... 49/352

(58) Field of Classification Search ..... 49/348, 49/349, 352, 502

See application file for complete search history.

(56) References Cited

U.S. PATENT DOCUMENTS 4,991,347 A * 2/1991 Takimoto et al. ..... 49/40
5,551,190 A 9/1996 Yamagishi et al.
6,061,963 A * 5/2000 Osborn et al. ..... 49/352
6,115,966 A * 9/2000 Shibata ..... 49/352
2007/0271849 A1 * 11/2007 Kriese et al. ..... 49/348

FOREIGN PATENT DOCUMENTS

JP 03-229046 10/1991
JP 06-323058 11/1994
JP 2006-037502 2/2006
JP 2006-348627 12/2006
JP 2007-239435 9/2007

* cited by examiner

*Primary Examiner*—Jerry Redman
(74) *Attorney, Agent, or Firm*—Finnegan, Henderson, Farabow, Garrett & Dunner, LLP

(57) ABSTRACT

A window regulator for a vehicle includes first, second, third, fourth belt guiding members, a loop belt member including a plurality of teeth at a first surface and installed on the belt guiding members with exhibiting an eight-shape, and a rotational member engaged with the belt member and driven by a motor. The belt member includes first and second moving portions, which are arranged in parallel with each other, and third and fourth moving portions, which are arranged to intersect each other. First and second supporting members are connected to the belt member at the first and second moving portions, respectively. First and second twisted portions are provided at the belt member at the third and fourth moving portions, respectively, by twisting the belt member for reversing first and second surfaces of the belt member. Accordingly, the teeth of the belt member contact all of the belt guiding members.

9 Claims, 5 Drawing Sheets

WINDOW REGULATOR FOR VEHICLE

CROSS REFERENCE TO RELATED APPLICATIONS

This application is based on and claims priority under 35 U.S.C. §119 to Japanese Patent Applications 2007-319591, filed on Dec. 11, 2008, and 2008-089660, filed on Mar. 31, 2008, the entire contents of which are incorporated herein by reference.

FIELD OF THE INVENTION

The present invention generally relates to a window regulator for a vehicle.

BACKGROUND

A window regulator for upwardly and downwardly moving a window glass of a vehicle is provided between an outer panel and an inner panel, which structure a door panel of the vehicle. The window glass is guided to move upwardly and downwardly by a pair of side frames. The window regulator operates a window glass supporting portion (connecting portion), which is fixedly provided at the window glass, to move upwardly and downwardly by means of a loop wire, thereby driving the window glass to move upwardly and downwardly. Such wire-operational type window regulator includes a window regulator with a guiding rails(s) for guiding a glass supporting portion thereof to move upwardly and downwardly, and a guideless window regulator which does not include such guiding rails.

JP2006-348627A (hereinafter, referred to as reference 1) and JP2007-239435A (hereinafter, referred to as reference 2) disclose the guideless wire-operational type window regulator. According to the references 1 and 2, a loop wire is wound around four guide members (pulleys) so as to exhibit a shape of an "8". Further, a part of the loop wire is wound around a drum. The drum is driven to rotate by an actuator in first and second rotational directions, so that the loop wire is moved along the 8-shaped locus. First and second window glass supporting portions are fixedly connected to the loop wire at first and second vertical positions, at which the loop wire moves in the vertical direction (upper and lower direction), on the locus of the loop wire, respectively. Accordingly, when the wire is driven to move by the drum, the window glass supporting portions are driven to move upwardly and downwardly.

However, according to the references 1 and 2, the loop wire is not covered with any covering member. Further, components of the window regulator, such as the guide members and the wire, are not fixed to one another. Therefore, a manual assembling operation for assembling the window regulator onto an inner surface of an inner panel of a door panel may be difficult. Further, when performing the manual assembling operation, element wires structuring the loop wire may be damaged when making contact with other members such as the door panel. Therefore, the loop wire may break by being cut.

A need thus exists for a window regulator, which is not susceptible to the drawback mentioned above.

SUMMARY OF THE INVENTION

According to an aspect of the present invention, a window regulator for a vehicle for upwardly and downwardly moving a window glass includes first, second, third and fourth belt guiding members, a looped belt member, a rotational member, a motor, and first and second supporting members. The first belt guiding member is adapted to be connected to a door panel of the vehicle. The second belt guiding member is adapted to be connected to the door panel with a space from the first belt guiding member. The third belt guiding member is adapted to be connected to the door panel at a lower side of the second belt guiding member. The fourth belt guiding member is adapted to be connected to the door panel at a lower side of the first belt guiding member. The belt member includes a plurality of teeth at a first surface thereof. The belt member is movably provided at the first, second, third and fourth belt guiding members and exhibits an eight-shape when installed thereon. The rotational member includes a tooth portion at an outer circumferential surface thereof. The tooth portion of the rotational member is engaged with the plurality of teeth of the belt member. The motor is adapted to be connected to the door panel and is employed for driving the rotational member to rotate in first and second rotational directions. The first and second supporting members are fixedly connected to the belt member for supporting the window glass. The belt member provided at the first, second, third and fourth belt guiding members includes a first moving portion between the first and fourth belt guiding members and a second moving portion between the second and third belt guiding members. The first and second moving portions are arranged to be in parallel with each other. The belt member further includes a third moving portion between the first and third belt guiding members and a fourth moving portion between the second and fourth belt guiding members. The third and fourth moving portions are arranged to intersect each other. The first and second supporting members are connected to the belt member at the first and second moving portions, respectively. Further, a first twisted portion and a second twisted portion are respectively provided at the belt member at the third and fourth moving portions by twisting the belt member thereat for reversing the first surface and a second surface of the belt member. Accordingly, the plurality of teeth formed at the first surface of the belt member contacts the first, second, third and fourth belt guiding members.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
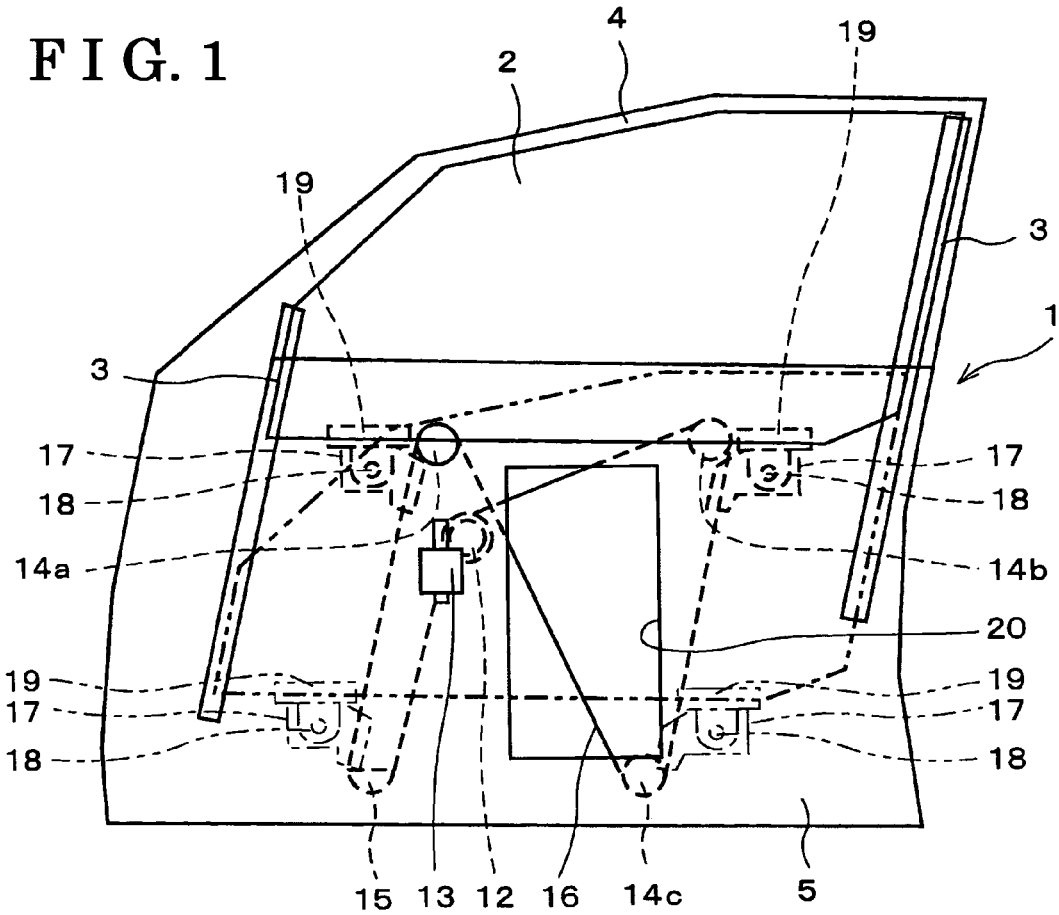
FIG. 1 is a schematic view illustrating a window regulator for a vehicle, which is provided at a door of the vehicle, seen from an interior side of the vehicle according to the embodiment.

An embodiment of the present invention will be described hereinafter with reference to the attached drawings. As illustrated in FIG. 1, a door 1 for a vehicle includes first and second side frames 3 and an upper frame 4 structuring an upper end of a window frame. A window glass 2 is guided by the first and second side frames 3 thereby moving upwardly and downwardly. An uppermost position of an upward movement of the window glass 2 is restrained by the upper frame 4. Hereinafter, directions, such as longitudinal (front and rear), lateral (left and right) and vertical (upper and lower), correspond to an orientation of the vehicle.

A window regulator 10 for a vehicle is provided at a space defined between an inner panel 5 (serving as a door panel), which is provided at the door 1 at an interior side of the vehicle, and an outer panel, which is provided at the door 1 at an exterior side of the vehicle. The window regulator 10 includes a first pulley 14*a* (serving as a first belt guiding member), a second pulley 14*b* (serving as a second belt guiding member), a third pulley 14*c* (serving as a third belt guiding member), a retainer 15 (serving as a fourth belt guiding member), a drum (gear) 12 of an actuator and a looped belt member 16 (torque transmitting member). The first and second pulleys 14*a* and 14*b* are located at a vertically upper position at the space defined between the inner panel 5 and the outer panel. The third pulley 14*c* and the retainer 15 are located at a vertically lower position at the space defined between the inner panel 5 and the outer panel. The drum 12 (serving as a rotational member) is located at a vertically intermediate position. The belt member 16 is movably wound to the first to third pulleys 14*a*, 14*b*, 14*c*, and the retainer 15 with exhibition of an eight-shape when installed thereon. The first to third pulleys 14*a*, 14*b*, and 14*c* rotate independently from one another about rotational axis thereof. Further, a tooth portion is formed at a circumferential surface of each of the first to third pulleys 14*a*, 14*b* and 14*c*. The belt member 16 includes a plurality of belt teeth 34 (serving as a plurality of teeth) at a first surface thereof. The tooth portion of each of the first, second and third pulleys 14*a*, 14*b*, 14*c* engages with the belt teeth 34 of the belt member 16. On the other hand, the retainer 15 does not include a tooth portion at a circumferential surface thereof. Instead, the retainer 15 includes a smooth surface (serving as a slidable surface) at the circumferential surface thereof. The retainer 15 is fixedly connected to the inner panel 5, so that a rotational movement of the retainer 15 is restrained. The belt member 16 slides on the smooth surface of the retainer 15. Thus, a moving direction of the belt member 16 is smoothly changed by the retainer 15. The drum 12 includes a tooth portion at a circumferential surface thereof. The tooth portion of the drum 12 engages with the belt teeth 34 of the belt member 16. The drum 12 is driven by a motor 13 to rotate in the clockwise and counterclockwise directions (serving as first and second rotational directions), thereby driving the belt member 16 to move in a first direction and a second direction.

Figure 2:
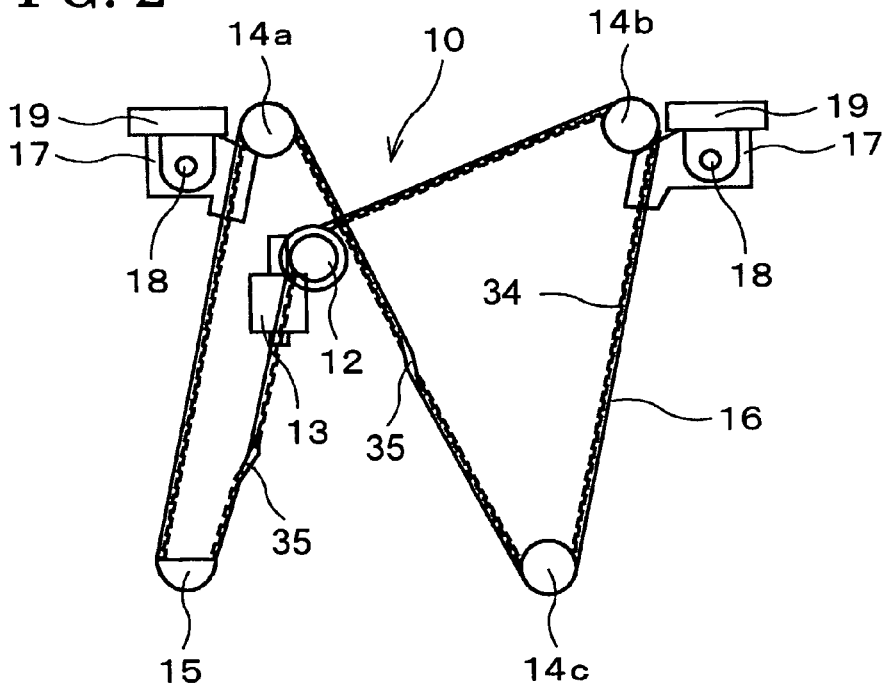
FIG. 2 is a schematic view illustrating the window regulator for the vehicle connected to an inner panel of the door of the vehicle.

As illustrated in FIGS. 1 and 2, at the space defined between the inner panel 5 an the outer panel, the first pulley 14*a* is connected to the inner panel 5 of the door 1 at a front upper position, and the second pulley 14*b* is connected to the inner panel 5 at a rear upper position with a space from the first pulley 14*a*. Further, the third pulley 14*c* is connected to the inner panel 5 at a lower side of the second pulley 14*b* (i.e., at a rear lower position), and the retainer 15 is connected to the inner panel 5 at a lower side of the first pulley 14*a* (i.e., at a front lower position). An outer tangent line contacting the first pulley 14*a* and the retainer 15 and an outer tangent line contacting the second and third pulleys 14*b*, 14*c* are arranged to be in parallel with each other. Therefore, a first moving portion of the belt member 16 being in a first moving range defined between the first pulley 14*a* and the retainer 15 and a second moving portion of the belt member 16 being in a second moving range defined between the second and third pulleys 14*b*, 14*c* are arranged to move in parallel with each other. The first and second moving portions of the belt member 16 function as a pair of parallel moving portions of the belt member 16. On the other hand, a third moving portion of the belt member 16 being in a third moving range defined between the first and third pulleys 14*a*, 14*c* intersects a fourth moving portion of the belt member 16 being in a fourth moving range defined between the second pulley 14*b* and the retainer 15. The third and fourth moving portions of the belt member 16 function as a pair of intersect moving portions of the belt member 16.

First and second carrier brackets 17 (serving as first and second supporting members) for supporting the window glass 2 are fixedly connected to the belt member 16 so as to be integral therewith at the first and second moving portions (the parallel moving portions) of the belt member 16, respectively. The first and second carrier brackets 17 are formed of resin, for example. Further, first and second glass supporting portions 19 are fixedly connected to a lower rim of the window glass 2 so as to support the window glass 2. The first and second glass supporting portions 19 are fixedly connected to the first and second carrier brackets 17 by means of bolts 18, respectively.

As described above, the belt teeth 34 are formed at the first surface of the belt member 16. The belt teeth 34 of the belt 16 engage with the tooth portion formed at the outer circumferential surface of the drum 12 and the tooth portion formed at the outer circumferential surface of each of the first, second and third pulleys 14*a*, 14*b*, 14*c*. The retainer 15 includes the smooth circumferential surface (a semi-circular surface) on which the belt member 16 slides. The moving locus of the belt member 16 is defined by the first, second, third pulleys 14*a*, 14*b*, 14*c*, the retainer 15 and the drum 12. A large load is applied to upper turning positions of the belt member 16 so as to upwardly move the window glass 2. Therefore, the first and second pulleys 14*a* and 14*b*, each of which includes the tooth portion at the circumferential portion thereof, are located at the upper positions. On the other hand, because a load applied to lower turning positions of the belt member 16 is small, the retainer 15 including the smooth circumferential surface and no tooth portion is located at the lower position. However, both of the third and fourth belt guiding members, which are respectively provided at the lower sides of the first and second pulleys 14*a*, 14*b*, may function as pulley members.

The inner panel 5 includes bores through which the first, second and third pulleys 14*a*, 14*b*, 14*c*, the retainer 15 and a housing of the actuator (the drum 12) are fixedly connected to the inner panel 5, respectively. More specifically, bolts are fixedly attached to the first, second and third pulleys 14*a*, 14*b*, 14*c*, respectively. The bolts fixed to the first to third pulleys 14*a* to 14*c* are respectively inserted into the bores formed at the inner panel 5 from a surface thereof which is adjacent to the outer panel (i.e., an outer surface of the inner panel 5), so that the bolts protrude to another surface of the inner panel 5 which is adjacent to an interior of the vehicle (i.e., an inner surface of the inner panel 5). Then, the bolts are tightened by nuts, respectively, from the inner surface of the inner panel 5. Thus, the first, second and third pulleys 14*a*, 14*b*, 14*c* are fixedly connected to the inner panel 5. In the same manner, the housing of the actuator (the drum 12) is fixedly connected to the inner panel 5 by means of a bolt and a nut through one of the bores formed at the inner panel 5. The retainer 15 is fixedly connected to the inner panel 5 by being hooked at one of the bores formed at the inner panel 5. In addition, an operation hole 20 is formed at the inner panel 5. An operator (manufacturer) may insert his/her hand into the space defined between the inner panel 5 and the outer panel through the operational hole 20.

Figure 6B:
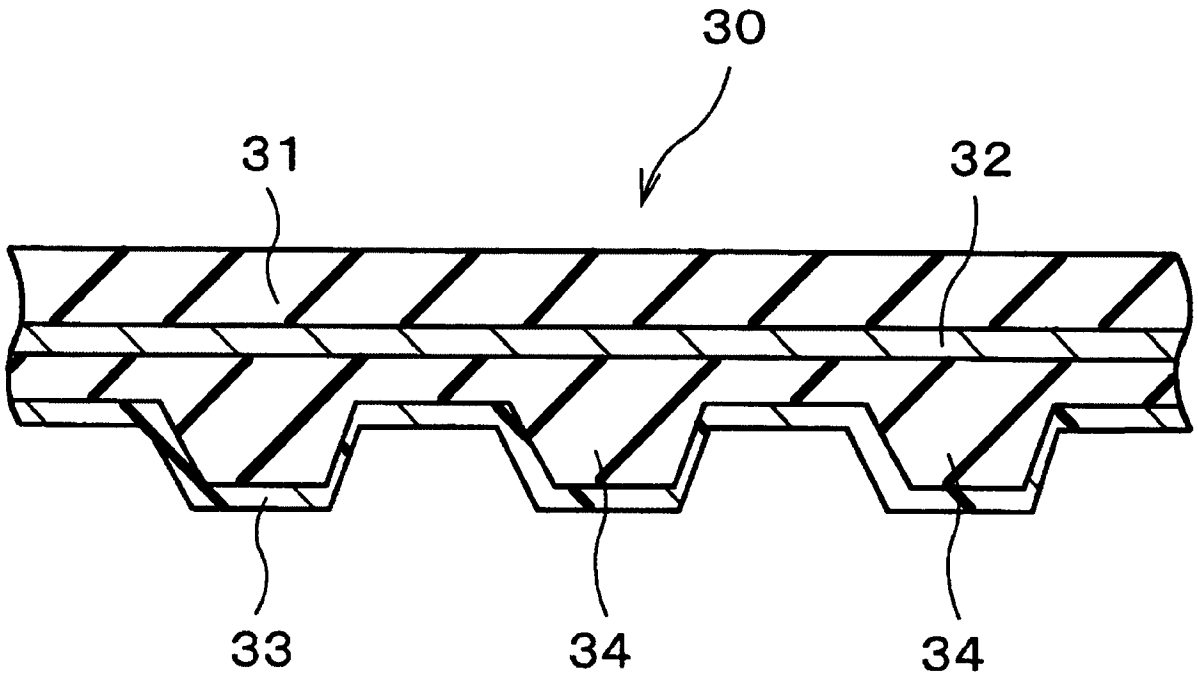
FIG. 6B is a longitudinal cross sectional view illustrating the belt body of the belt member.
Figure 6A:
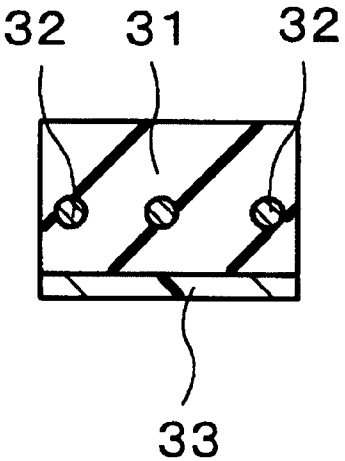
FIG. 6A is a lateral cross sectional view illustrating a belt body of a belt member applied to the window regulator, according to the embodiment.
Figure 7:
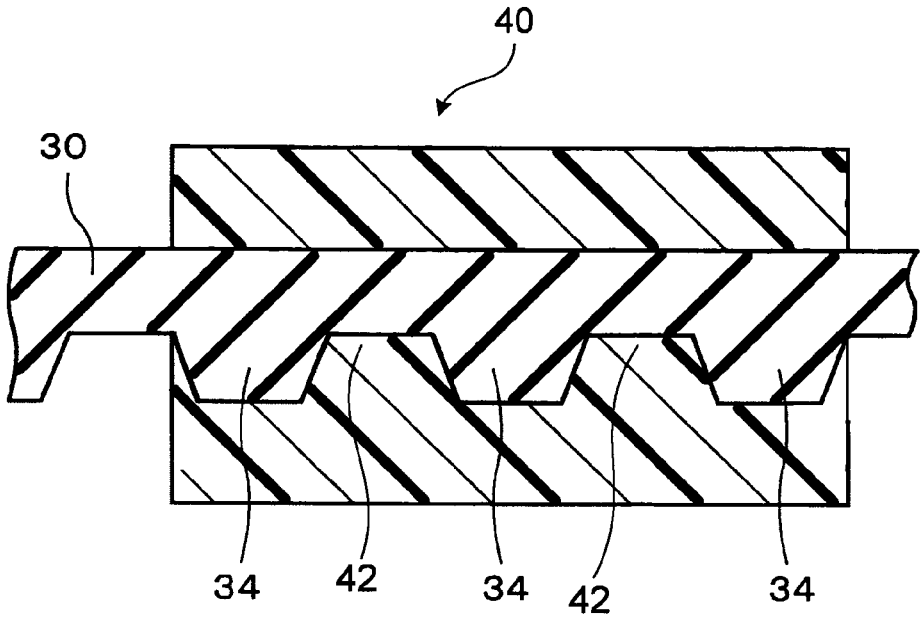
FIG. 7 is a longitudinal cross sectional view illustrating the belt body and a connecting member.

As illustrated in FIGS. 6A and 6B, a belt body 30 of the belt member 16 is structured with a rubber belt 31, which is made of rubber material, such as chloroprene rubber or acrylonitrile butadiene (NBR). The plural belt teeth 34 are formed at a first surface of the rubber belt 31 of the belt body 30 (i.e., at a first surface of the belt member 16). Further, nylon fabric 33 (tooth fabric) covers the belt teeth 34 of the belt member 16. The nylon fabric 33 is coated with (or soaks) lubricant. Still further, plural cable cores 32 extending in a longitudinal direction of the belt member 16 are embedded in the rubber belt 31, thereby reinforcing the rubber belt 31 of the belt body 30. The cable cores 32 are made of glass fibers, for example. According to the embodiment, three of the cable cores 32 are provided in the rubber belt 31 in a width direction thereof. Further, a connecting member 40 of the carrier bracket 17, which is made of resin, for example, may be fixed to the belt member 16 so as to be integral therewith by molding as illustrated in FIG. 7.

According to the embodiment, first and second twisted portions 35 are provided at the belt member 16 at the third and fourth moving portions, respectively. More specifically, the first and second twisted portions 35 are formed by twisting the belt member 16 at the third and fourth moving portions (i.e., the intersect moving portions), so that the first surface and a second surface thereof are reversed. At one of the third and fourth moving portions, at which the motor 13 (the drum 12) is not provided, the twisted portion 35 may be positioned anywhere within the corresponding moving portion (i.e., according to the embodiment, the position of the twisted portion 35 provided at the third moving portion of the belt member 16 may be determined flexibly). On the other hand, at the other of the third and fourth moving portions of the belt member 16, at which the motor 13 (the drum 12) is provided, the twisted portion 35 is provided between the corresponding pulley 14*c* or the retainer 15 and a position where the drum 12 driven by the motor 13 engages with the belt teeth 34 of the belt member 16. According to the embodiment, the motor 13 (the drum 12) is provided at the fourth moving portion of the belt member 16, so that the twisted portion 35 is provided between the retainer 15 and the position of the drum 12. So configured, the first surface of the belt member 16, at which the belt teeth 34 is formed, contacts the first, second and third pulleys 14*a*, 14*b*, 14*c* and the retainer 15. Accordingly, the belt teeth 34 of the belt member 16 engage with the tooth portion of each of the first to third pulleys 14*a*, 14*b* and 14*c*. Further, the belt teeth 34 covered with the nylon fabric coated with the lubricant slide on the smooth circumferential surface of the retainer 15.

Next, an operation of the window regulator 10 will be described hereinafter. As illustrated in FIGS. 1 and 2, when the drum 12 is driven by the motor 13 to rotate in the first and second rotational directions, the belt member 16 is moved in first and second moving directions, respectively. When the belt member 16 is moved in the first moving direction, the belt member 16 is moved upwardly from the retainer 15 towards the first pulley 14*a* at the first moving portion. At this time, the belt member 16 is upwardly moved from the third pulley 14*c* towards the second pulley 14*b* at the second moving portion. Accordingly, the first and second carrier brackets 17, which are fixedly connected to the belt member 16 at the first and second moving portions (the parallel moving portions) of the belt member 16, are moved upwardly. Therefore, the window glass 2 supported by the supporting portions 19 connected to the carrier brackets 17 is moved upwardly. On the other hand, when the belt member 16 is moved in the second direction, the first and second carrier brackets 17 are downwardly moved, thereby downwardly moving the window glass 2.

According to the embodiment, the belt member 16 (rubber belt), not a wire, is employed as a driving member for moving the window glass. The rigidity of the belt member is higher than that of a wire member. Accordingly, the belt member 16 is manually assembled to the door 1 easily. Further, the belt member 16 is hardly damaged, so that the window regulator 10 has a long operating life time. Still further, the first and second twisted portions 35 are provided at the belt member 16 at the third and fourth moving portions (intersect moving portions), respectively, for reversing the first and second surfaces of the belt member 16. Accordingly, the belt teeth 34 of the belt member 16, which includes a high sliding characteristic because of the tooth fabric, is in contact with the first, second and third pulleys 14*a*, 14*b*, 14*c* and the retainer 15. Still further, in comparison with a window regulator including a wire as a driving member for moving the window glass, a guiding rail(s) for guiding the wire is not required. Accordingly, the weight of the window regulator according to the embodiment may be reduced.

Figure 3:
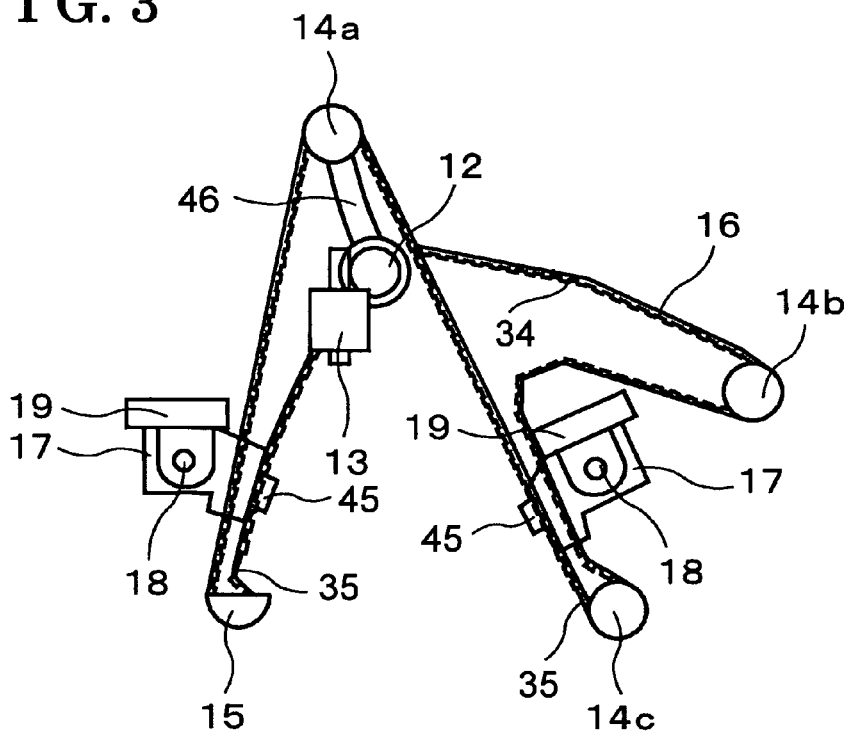
FIG. 3 is a schematic view illustrating the window regulator for the vehicle before being assembled to the door of the vehicle.
Figure 4A:
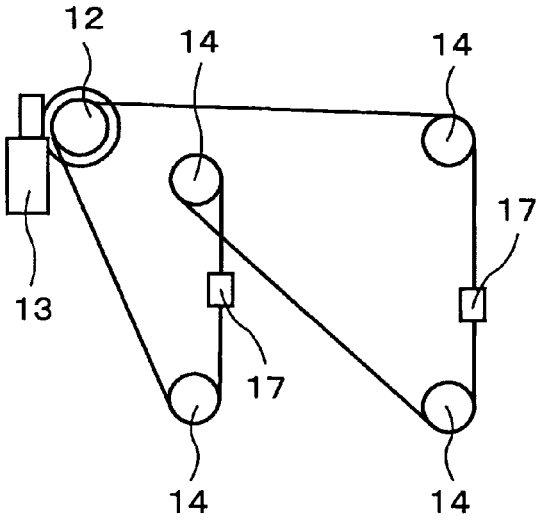
FIG. 4A is a schematic view illustrating a window regulator for a vehicle, according to a first comparative example.
Figure 4B:
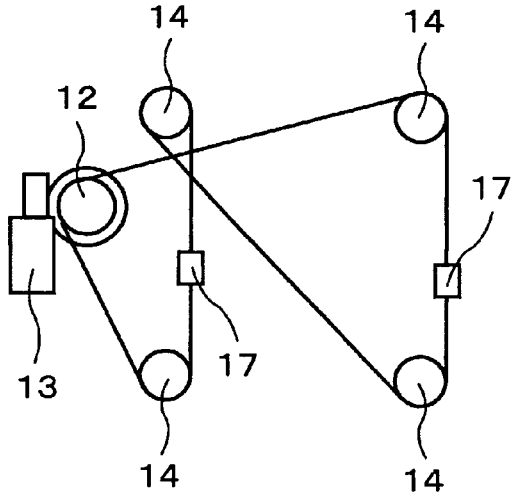
FIG. 4B a schematic view illustrating a window regulator for a vehicle, according to a second comparative example.

The above described embodiment may be modified as illustrated in FIGS. 3, 4A and 4B. For example, the belt member 16 may be wound to (installed on) four of the pulleys 14 and the drum 12 of the motor 13 as illustrated in FIGS. 4A and 4B. Accordingly, the belt teeth 34 formed at the first surface of the belt member 16 are always engaged with the retainers 14 without providing the twisted portions 35 at the belt member 16. So configured, two of the carrier brackets 17 are fixedly connected to the belt member 16 at the parallel moving portions (vertical moving portions), respectively. When the belt member 16 is installed on the pulleys 14 and the drum 12 in a state as illustrated in FIG. 4A, one of the carrier brackets 17, which is connected to a front vertical moving portion of the belt member 16 arranged between the upper front and lower front pulleys 14, moves while intersecting another portion of the belt member 16 which is arranged between the upper front and lower rear pulleys 14 (hereinafter, the portion arranged between the upper front and lower rear pulleys 14 is referred to as a diagonal portion). Further, the front vertical moving portion intersects the diagonal portion of the belt member 16 at the vicinity of the front upper pulley 14. In order to prevent the front vertical moving portion and the diagonal portion of the belt member 16 from contacting (interfering) each other, a moving locus of the belt member 16 is required to be adjusted in a thickness direction of the door 1. Therefore, in a state where the belt member 16 is arranged as illustrated in FIG. 4A, a wide space is required in a width direction of the belt member 16 so as to prevent the carrier bracket 17 and the belt member 16 from interfering (making contact with) each other. Therefore, the space defined between the inner panel 5 and the outer panel is required to be enlarged.

On the other hand, in a structure where the belt member 16 is arranged as illustrated in FIG. 4B, in addition to the above described intersecting portion between the front vertical moving portion and the diagonal portion of the belt member 16, another portion of the belt member 16 arranged between the drum 12 and the upper rear pulley 14 intersects the front vertical moving portion and the diagonal portion of the belt member 16 at the vicinity of the upper front pulley 14. Accordingly, the belt member 16 may require to be installed on the pulleys 14 so as to prevent such intersecting portions from interfering each other.

According to the embodiment as illustrated in FIGS. 1 and 2, the belt member 16 intersects at one position, i.e., between the third and fourth moving portions thereof. Further, an intersect point between the third and fourth moving portions of the belt member 16 may be determined at an appropriate position. Therefore, the third and fourth moving portions (intersect portions) of the belt member 16 are easily prevented from contacting (interfering) each other when the belt member 16 is installed on the pulleys 14*a*-14*c* and the retainer 15.

The window regulator 10 may includes clamp members 45 to connect third and fourth moving portions of the belt member 16 with the first and second carrier brackets 17 as shown in FIG. 3. The window regulator 10 may be carried (transferred) in a state as illustrated in FIG. 3 before being assembled to the inner panel 5. When carrying the window regulator 10, first and second clamp members 45 are respectively fixed to the first and second carrier brackets 17 at the first and second moving portions (parallel moving portions) of the belt member 16. The fourth moving portion of the belt member 16 is clamped by the first clamp member 45 of the first carrier bracket 17 connected to the first moving portion of the belt member 16, while the third moving portion of the belt member 16 is clamped by the second clamp member 45 of the second carrier bracket 17 connected to the second moving portion of the belt member 16. Further, a resin made or steel made clamp member 46 (serving as a third clam member) is provided between the first pulley 14*a* and the drum 12 (the housing of the actuator), so that the first pulley 14*a* and the housing of the actuator are bundled. Thus, by bundling (clamping) the belt member 16, an entire structure of the window regulator 10 is integrated. Accordingly, the operator may insert the window regulator 10 into the space defined between the inner panel 5 and the outer panel through the manual operation bore 20 while holding the motor 13, which is the heaviest member of the components structuring the window regulator 10. Then, the motor 13, the drum 12 and the first pulley 14*a* are temporary assembled onto the inner panel 5. A length of the clamp member 46 is adjusted to correspond to a distance between a position where the drum 12 is assembled onto the inner panel 5 and a position where the first upper pulley 14*a* is assembled onto the inner panel 5. Next, the retainer 15 and the second pulley 14*b* are temporary assembled onto the inner panel 15. Further, the first and second clamp members 45 are removed from the belt member 16, and the third pulley 14*c* is temporary assembled onto the inner panel 5. After that, the first to third pulleys 14*a*, 14*b*, 14*c*, the retainer 15, and the drum 12 are all fixedly connected to the inner panel 5 by the bolts and nuts. The belt member 16 is clamped by the clamp members 45 and 46 in a state where the first and second twisted portions 35 are provided at the belt member 16. The second twisted portion 35 is provided between the first clamp member 45 and the retainer 15, and the first twisted portion 35 is provided between the second clamp member 45 and the third lower pulley 14*c*. Thus, by providing the first and second twisted portions 35 at the vicinity of the third pulley 14*c* and the retainer 15, which are connected to the inner panel 5 in a latter half of an assembling operation of the window regulator 10, positions of the twisted portions 35 are not changed when assembling the window regulator 10 to the inner panel 5 of the door 1. Accordingly, the assembling operation of the window regulator 10 is easily executed. According to the embodiment, the clamp member 46 is connected between the first pulley 14*a* and the housing of the actuator (the drum 12). Alternatively, the clamp member 46 may be connected between the second pulley 14*b* and the housing of the actuator (the drum 12) when the drum 12 is provided at the third moving portion of the belt member 16 (i.e., at the range between the first and third pulleys 14*a* and 14*c*).

Next, a structure of the belt member 16, at which the resin-molded carrier bracket(s) 17 is integrally formed therewith, will be described in detail. The structure of the belt member 16 according to the embodiment is based on a background described hereinbelow.

As an example of such belt member, JP1991-29046A (hereinafter, referred to as reference 1) discloses a fixing apparatus for a toothed belt, which is employed for fixing a carrier member to the toothed belt. According to the reference 1, a groove portion is formed at the carrier member, and a protruding portion is provided inside the groove portion at the vicinity of an end portion of the groove portion. The toothed belt is bent to exhibit an U-shape, so that a first portion and a second portion of the toothed belt are engaged with each other. A width length of the groove portion is arranged to be approximately the same as the thickness of the engaged portion of the toothed belt (at which the first and second portions are engaged). Then, the U-shaped portion of the toothed belt is fitted into the groove portion so that the protruding portion of the groove portion is positioned inside a bent portion of the U-shaped portion of the toothed belt. Thus, the toothed belt is connected to the carrier member.

Further, JP2006-37502 (hereinafter, referred to as reference 2) discloses a door opening/closing apparatus for a vehicle including a belt member, and JP1994-323058A (hereinafter, referred to as reference 3) discloses an automatic opening/closing apparatus of a slide door of the vehicle including a belt member. According to the belt member disclosed in each of the references 2 and 3, a plurality of teeth is formed at one surface of the belt member. Further, a first iron plate (toothed plate) including a plurality of teeth is provided on one surface, which includes the teeth, of the belt member so that the teeth of the first iron plate and the teeth of the belt member are engaged. Still further, a second iron plane plate (back plane plate) is provided on the belt member at another surface thereof which does not include the teeth. Thus, the belt member is sandwiched by the first and second iron plates, thereby structuring a three-layered structure. The three-layered structure is fastened by bolts, which are inserted therethrough, and nuts. Further, an extending portion extends from one of the first and second plates. The extending portion functions as a connecting portion, through which the belt member is connected to other members of the apparatus.

According to the reference 1, however, a cover member is required in order to prevent the toothed belt from disconnecting from the groove portion of the carrier member after the toothed belt is fitted into the groove portion. Accordingly, the manufacturing cost of the fixing apparatus may become high. Further, when pulling force is applied to the toothed belt, the force partially acts on corner portions formed at an opening (entrance portion) of the groove portion of the carrier member. Accordingly, a large pulling force may not be applied to the belt member. Still further, because the groove portion is provided at the carrier member, a longitudinal length of the groove portion from the opening thereof to the protruding portion formed therein may become large. Thus, because the longitudinal length of the groove portion is large, the size of the carrier member may also be enlarged.

According to the references 2 and 3, because the belt member is sandwiched by the first and second iron plates and fixedly connected by connecting members such as the bolts and nuts, the number of components is increased. Accordingly, the manufacturing cost may be increased and the weight of the apparatus may also be increased. Further, because the belt member is sandwiched by the first and second iron plates and is fixedly connected by the bolts and nuts, the assembly of the belt member may be complicated. Still further, completely engaging the teeth of the first iron plate and the teeth of the belt member is difficult, so that simultaneously engaging all the teeth of the first iron plate and the belt member is also difficult. In addition, the engagement between the teeth of the iron plate and the teeth of the belt member may be partially released when the belt member is pulled, thus leading to reduction of resistibility of the belt member.

A need thus exists for a belt member, which prevents large load from being partially applied thereon and of which size, weight and manufacturing cost are reduced.

Back to the embodiment of the present invention, the structure of the belt member 16 will be described in detail with reference to FIG. 7. A part of the belt body 30 of the belt member 16 is inserted into a die for resin molding. Then, resin material is injected into a space defined by the die and solidified around the part of the belt body 30 in the space defined by the die, thereby molding the belt body 30 by the resin material. Thus, as illustrated in FIG. 7, a resin-molded portion 41 of the connecting member 40, in which the belt body 30 is incorporated, is obtained. Because the resin material flows into spaces defined between each of the belt teeth 34 of the belt body 30 and solidifies when molding the resin molded portion 41, the resin-molded portion 41 adheres the belt body 30 by contacting not only a plane surface (a second surface) of the belt body 30, at which the belt teeth 34 are not formed, but also the protruded and recessed surface (the first surface) thereof, at which the belt teeth 34 are formed. When molding the resin-molded portion 41, the resin material flows into at least one recessed groove portion formed between the belt teeth 34 of the belt body 30 and solidifies thereat, thereby forming at least one protruding portions 42 fixedly fitted in the groove portion(s) between the belt teeth 34. According to the embodiment, the resin-molded portion 41 of the connecting member 40 includes two of the protruding portions 42 as illustrated in FIG. 7. The protruding portions 42 are engaged with the belt teeth 34 of the belt body 30, respectively. Therefore, the belt body 30 and the resin-molded portion 41 of the connecting member 40 are tightly fixedly connected to each other. According to the embodiment, three of the belt teeth 34 of the belt body 30 are integrally formed with the connecting member 40 as illustrated in FIG. 7.

Next, an operation of the belt member 16 according to the embodiment will be described hereinafter. The connecting member 40 functions as the entire structure of the carrier bracket 17 or a part of the carrier bracket 17 which is fixedly connected to the belt member 16. The belt body 30 structures the loop belt member 16. According to the embodiment, the connecting member 40 is formed at the belt member 30 so as to be integral therewith by resin molding. More specifically, the intermediate protruding portions 42 of the resin-molded portion 41 of the connecting member 40 are formed to match the recessed portions and the protruding portions (the belt teeth 34) of the belt body 30, thereby tightly connecting the resin-molded portion 41 of the connecting member 40 and the belt body 30. Accordingly, a contacting area between the belt body 30 and the connecting member 40 is largely obtained. Therefore, the acting force applied to one of the belt member 30 and the connecting member 40 is transmitted to the other of the belt member 30 and the connecting member 40 from the contacting area therebetween and is dispersed to evenly act on each of the belt teeth 34 of the belt body 30. Accordingly, the strength of the belt member 16 may not partly differ. Thus, according to the embodiment, the high strength of the belt member 16 may be assured, so that a large driving force may be applied to the belt body 30 of the belt member 16.

Further, because the connecting member 40 may be fixedly formed at the belt body 30 so as to be integral therewith by resin molding, the connecting member 40 includes only one component (the resin-molded portion 41). In other words, the number of the connecting member 40 is extremely small. Accordingly, the connecting member 40 is easily manufactured, thereby reducing the manufacturing cost thereof. The connecting member 40 may only form to fill the recessed portions formed between each of the belt teeth 34 of the belt body 30. Accordingly, the width of the connecting member 40 in a vertical direction to the surfaces of the belt member 30 is reduced, thereby reducing the size and weight of the connecting member 40.

Figure 8:
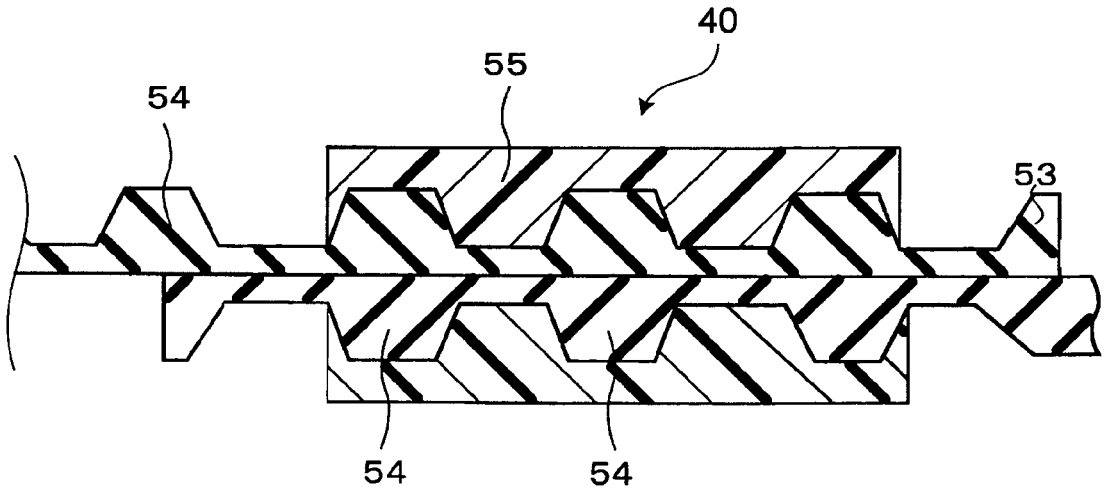
FIG. 8 is a longitudinal cross sectional view illustrating a belt body and a connecting member, according to a modified embodiment.

The structure of the belt member 16 may be modified as illustrated in FIG. 8. The belt member 16 may include first and second body portions 53, which are connected with each other. More specifically, first surfaces of the first and second body portions 53, at which a plurality of belt teeth 54 are formed, are directed in opposite directions relative to each other, and second surfaces of the first and second body portions 54, at which the belt teeth 54 are not formed, are brought to contact with each other. Then, the first and second body portions 53 are integrally connected with each other by resin molding. Thus, according to the embodiment, the second surfaces (back surfaces) of the first and second body portions 53 are connected with each other. Further, a resin-molded portion 55 of the connecting member 40 is connected to the first and second body portions 53. In such structure, the first and second body portions 53 are integrally connected by the resin-molded portion 55 of the connecting member 40. Alternatively, as illustrated in FIG. 8, when the belt member 16 includes one body portion 53 including the plurality of teeth 54 at the first surface thereof, first and second end portions of the body portion 53 (the belt member 16) may be arranged to contact with each other at the second surface of the body portion 53. Then, the connecting member 40 may be formed at a contacting portion between the first and second end portions of the body portion 53 so as to be integral therewith by resin molding. Thus, the resin-molded portion 55 may function as a connecting portion for forming the belt member 16 into a closed loop by connecting the end portions thereof.

Figure 5:
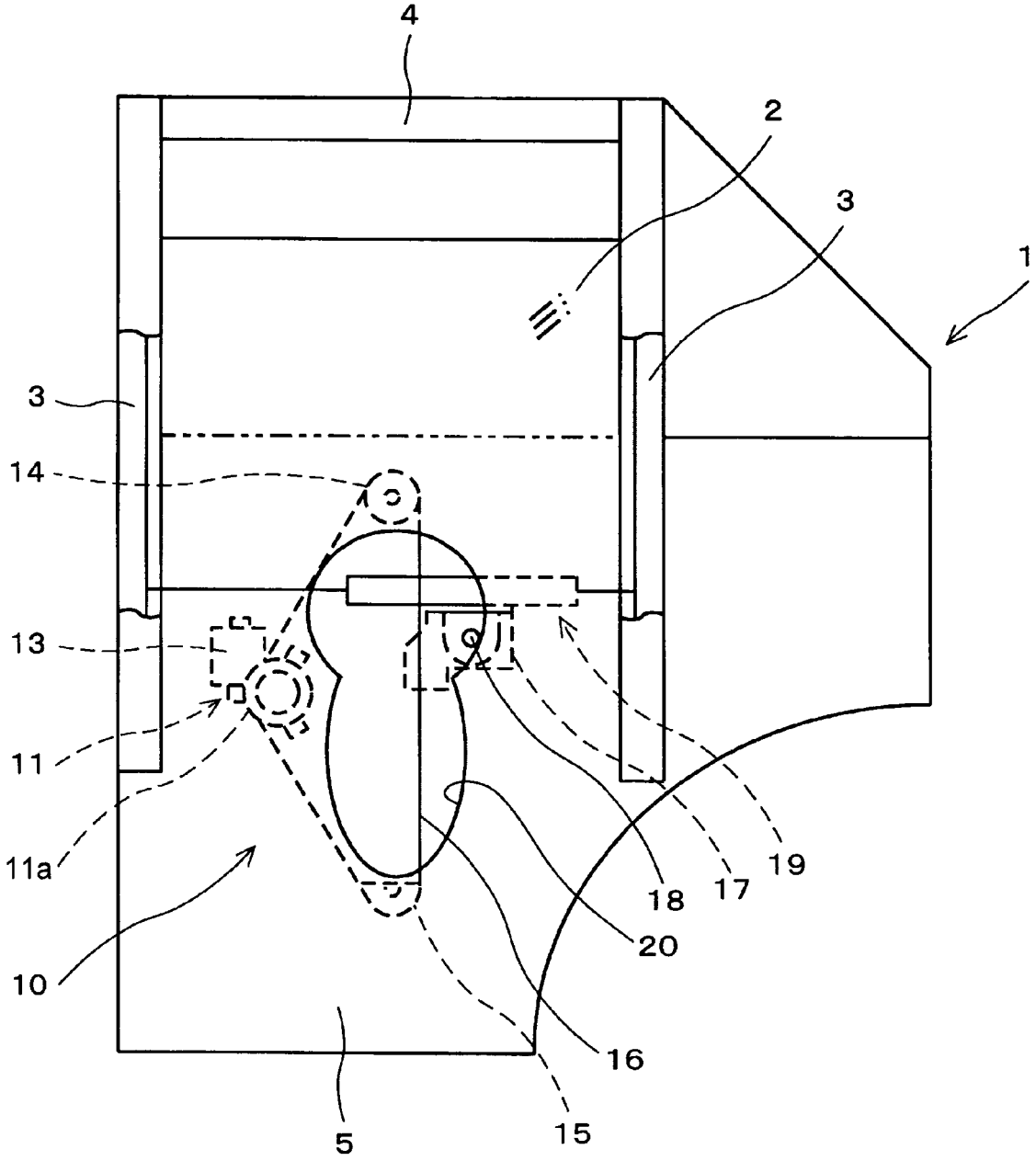
FIG. 5 is a schematic view illustrating another structure of a window regulator for a vehicle, which is provided at the door of the vehicle, seen from an interior side of the vehicle.

Additionally, the above described structure of the belt member 16 may be applied not only to the window regulator 10 illustrated in FIG. 1 but also to a window regulator 10 illustrated in FIG. 5, as an example.

As illustrated in FIG. 5, the window regulator 10 is provided at the space defined between the inner panel 5 and the outer panel of the door 1. The window regulator 10 includes a pulley 14, the retainer 15, a holder 11*a* of an actuator 11, and the loop belt member 16. The pulley 14 is connected to the inner panel 5 at an upper area thereof, whereas the retainer 15 is connected to the inner panel 5 at a lower area thereof. The holder 11*a* of the actuator 11 is connected to the inner panel 5 at a vertically intermediate area between the pulley 14 and the retainer 15. The belt member 16 is installed on the pulley 14, the retainer 15 and the holder 11*a*. The motor 13 of the actuator 11 rotatably drives the holder 11*a*, thereby driving the belt member 16 in the first and second directions. The plural belt teeth 34 of the belt member 16 is engaged with a tooth portion formed at an outer circumferential portion of the holder 11*a* and a tooth portion formed at an outer circumferential portion of the pulley 14 when being installed thereon. The retainer 15 includes the sliding circumferential surface (semi-circular surface), on which the belt member 16 slides. The moving locus of the belt member 16 is determined by the pulley 14, the retainer 15 and the holder 11*a* of the actuator 11. Further, a moving portion of the belt member 16 between the pulley 14 and the retainer 15 is directed in the upper and lower direction, thereby moving the window glass 2 upwardly and downwardly. Because a large load is applied at an upper turning portion of the belt member 16, the pulley 14 including the tooth portion is provided at the upper area of the inner panel 5. On the other hand, because the load applied to a lower turning portion of the belt member 16 is small, the retainer 15 including the sliding surface, on which the belt member 16 smoothly slides, is provided at the lower area of the inner panel 5.

The resin-made carrier bracket 17 is fixedly connected to the belt member 16 between the pulley 14 and the retainer 15 so as to be integral with the belt member 16. Further, the window glass supporting portion 19 is fixedly connected to the lower end of the window glass 2. The glass supporting portion 19 and the carrier bracket 17 are fixedly connected to each other by means of the bolt 18.

Other components, such as the door 1, the inner panel 5, the side frames 3, the upper frame 4 and the window glass 2, include substantially the same structure of the window regulator 10 illustrated in FIG. 1. Therefore, the description will be omitted herein.

The present invention is not limited to the embodiment described above. According to the embodiment, the plurality of belt teeth 34 is formed at the first surface of the belt body 30 of the belt member 16. Alternatively, the plurality of belt teeth 34 may be formed at both of the first and second surfaces of the belt body 30, and the resin-molded portion 41 (the connecting member 40) may be provided at such belt member 16, as an example. Still further, the belt member 16 including the plurality of belt teeth 34 may be applied not only to the window regulator (glass moving apparatus) but also to any belt members for various uses.

According to the embodiment of the present invention, the belt member 16, which is installed on the pulleys 14*a*, 14*b*, 14*c* and the retainer 15 (first, second, third and fourth belt guiding members) is employed as a torque transmitting member in place of a wire. The rigidity of the belt member 16 is higher than that of the wire. Accordingly, the belt member 16 is hardly damaged, so that the window regulator 10 has a long operating life time. Further, the first and second twisted portions 35 are formed at the third and fourth moving portions of the belt member 16, respectively, by twisting the belt member 16 for reversing the first surface and the second surface of the belt member 16. Accordingly, the first surface of the belt member 16, at which the plurality of belt teeth 34 are formed, are brought to contact with all of the first, second, third pulleys 14*a*, 14*b*, 14*c* and the retainer 15. The belt member 16 is structured with a body portion (base material) 34, which is made of rubber material, and the plurality of belt teeth 34, which is made by covering a base material with tooth fabric such as nylon fabric. The belt teeth 34 coated with the tooth fabric has high sliding characteristic. Accordingly, the material with the high sliding characteristic is brought to contact with the pulleys 14 (14*a*, 14*b*, 14*c*) and the retainer 15. Therefore, the belt member 16 moves smoothly. Further, because the first and second twisted portions 35 are provided at the belt member 16, the assembling operation of the window regulator 10 is easily executed.

According to the embodiment described above, the drum 12 (rotational member) is engaged with the belt member 16 at one of the third and fourth moving portions of the belt member. Further, one of the first and second twisted portions 35 provided at one of the third and fourth moving portions, at which the drum 12 is provided, is positioned between the corresponding third or fourth belt guiding members (the third pulley 14*c* or the retainer 15) and a position of the drum 12.

Still further, the first and second belt guiding members includes the first and second pulleys 14*a*, 14*b*, respectively. Further, at least one of the third and fourth belt guiding members includes a pulley members. Each pulley member has a tooth portion at an outer circumferential surface thereof. The tooth portion of each pulley member engages with the plurality of belt teeth 34 of the belt member 16 when the belt member 16 is installed thereon.

Still further, when one of the third and fourth belt guiding members includes the pulley member (as the third pulley 14*c*), the other one of the third and fourth belt guiding members includes a retainer (the retainer 15) having a slidable surface at an outer circumferential surface thereof. Further, the drum 12 is engaged with the belt member 16 at one of the third and fourth moving portions, one of which is arranged between the other one of the third and fourth belt guiding members including the retainer and the corresponding first or second belt guiding members. According to the embodiment described above, the drum 12 is engaged with the belt member 16 at the third moving portion, which is arranged between the third pulley 14*c* and the second pulley 14*b*.

Still further according to the embodiment described above, the belt member 16 includes the body portion 30 having the plurality of teeth 34 at at least one of first and second surfaces thereof. Further, the belt member 16 includes the connecting member 40 formed of resin and integrally connected to the body portion 30 of the belt member 16 by molding. Due to the above described structure, because the connecting member 40 is integrally connected to the body portion 30 of the belt member 16 by resin molding, the connecting member 40 includes only one component (the resin-molded portion 41). Thus, the number of the connecting member 40 is extremely small. Accordingly, the size and weight of the connecting member 40 are reduced and the manufacturing cost of the connecting member 40 is also reduced.

Further, the connecting member 40 includes at least one protruding portion 42 fixedly fitted in at least one groove portion defined between the belt teeth 34 of the body portion 30.

Still further, when the body portion 53 (30) includes the plurality of belt teeth 54 (34) at the first surface thereof, the first and second end portions of the body portion 53 are arranged to contact with each other at the second surface of the body portion. Then, the connecting member 40 is formed at the contacting portion between the first and second end portions of the body portion 53 so as to be integral therewith by resin molding.

Still further, the belt member 30 includes the first body portion 53 including the plurality of belt teeth 54 at the first surface thereof and the second body portion 53 including the plurality of belt teeth 54 at the first surface thereof. The second surface of the first body portion 53 and the second surface of the second body portion 53 are arranged to contact each other. Then, the connecting member 40 is formed at the first and second body portions 53 of the belt member 16 so as to be integral therewith by resin molding for integrally connecting the first and second body portions 53.

Due to the above described structure, the resin material flows into the groove portion(s) defined between each of the belt teeth 34 of the belt body 30 and then solidifies when molding the resin molded portion 41 of the connecting member 40. At least one protruding portion 42 fixedly fitted in at least one groove portion defined between the belt teeth 34 is accordingly obtained. Therefore, the strength of the connecting portion between the connecting member 40 and the belt body 30 is increased.

Further, by applying the belt member 16 according to the above described structure to the window regulator 10 for the vehicle, the weight of the vehicle may be reduced. Further, the operating life time of the window regulator 10 may be extended. Still further, the assembling operation of the window regulator 10 to the door panel (inner panel 5 of the door 1) may be easily executed.

Still further according to the embodiment described above, each of the first and second carrier brackets 17 are fixedly connected to the belt member 16 via the connecting member 40.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A window regulator for a vehicle for upwardly and downwardly moving a window glass, comprising:

a first belt guiding member adapted to be connected to a door panel of the vehicle;

a second belt guiding member adapted to be connected to the door panel with a space from the first belt guiding member;

a third belt guiding member adapted to be connected to the door panel of the vehicle at a lower side of the second belt guiding member;

a fourth belt guiding member adapted to be connected to the door panel of the vehicle at a lower side of the first belt guiding member;

a looped belt member including a plurality of teeth at a first surface thereof; the belt member being movably provided at the first, second, third and fourth belt guiding members and exhibiting an eight-shape when installed thereon;

a rotational member including a tooth portion at an outer circumferential surface thereof, the tooth portion being engaged with the plurality of teeth of the belt member;

a motor adapted to be connected to the door panel and driving the rotational member to rotate in first and second rotational directions; and first and second supporting members fixedly connected to the belt member for supporting the window glass, wherein the belt member provided at the first, second, third and fourth belt guiding members includes a first moving portion between the first and fourth belt guiding members and a second moving portion between the second and third belt guiding members, the first and second moving portions being arranged to be in parallel with each other, the belt member further includes a third moving portion between the first and third belt guiding members and a fourth moving portion between the second and fourth belt guiding members, the third and fourth moving portions being arranged to intersect each other, the first and second supporting members are connected to the belt member at the first and second moving portions, respectively, and wherein a first twisted portion and a second twisted portion are respectively provided at the belt member at the third and fourth moving portions by twisting the belt member thereat for reversing the first surface and a second surface of the belt member, whereby the plurality of teeth formed at the first surface of the belt member contacts the first, second, third and fourth belt guiding members.

2. A window regulator for a vehicle, according to claim 1, wherein the rotational member is engaged with the belt member at one of the third and fourth moving portions of the belt member, and one of the first and second twisted portions provided at one of the third and fourth moving portions, at which the rotational member is provided, is positioned between the corresponding third or fourth belt guiding members and a position of the rotational member.

3. A window regulator for a vehicle, according to claim 1, wherein each of the first and second belt guiding members and at least one of the third and fourth belt guiding members include pulley members, each pulley member having a tooth portion at an outer circumferential surface thereof, the tooth portion engaging with the plurality of teeth of the belt member when the belt member is installed thereon.

4. A window regulator for a vehicle, according to claim 3, wherein when one of the third and fourth belt guiding members includes the pulley member, the other one of the third and fourth belt guiding members includes a retainer having a slidable surface at an outer circumferential surface thereof, and the rotational member is engaged with the belt member at one of the third and fourth moving portions, one of which is arranged between the other one of the third and fourth belt guiding members including the retainer and the corresponding first or second belt guiding members.

5. A window regulator for a vehicle, according to claim 1, wherein the belt member includes a body portion having the plurality of teeth at at least one of first and second surfaces thereof, and a connecting member formed of resin and integrally connected to the body portion by molding.

6. A window regulator for a vehicle, according to claim 5, wherein the connecting member includes at least one protruding portion fixedly fitted in at least one groove portion defined between the teeth of the body portion.

7. A window regulator for a vehicle, according to claim 5, wherein when the body portion includes the plurality of teeth at the first surface thereof, first and second end portions of the body portion are arranged to contact with each other at a second surface of the body portion, and the connecting member is formed at a contacting portion between the first and second end portions of the body portion so as to be integral therewith by molding.

8. A window regulator for a vehicle, according to claim 5, wherein the belt member includes a first body portion including a plurality of teeth at a first surface thereof and a second body portion including a plurality of teeth at a first surface thereof, a second surface of the first body portion and a second surface of the second body portion are arranged to contact each other, and the connecting member is formed at the first and second body portions of the belt member so as to be integral therewith by resin molding for integrally connecting the first and second body portions.

9. A window regulator for a vehicle, according to claim 5, wherein each of the first and second supporting members is fixedly connected to the belt member via the connecting member.

* * * * *